US008667726B1

(12) United States Patent
Huff

(10) Patent No.: US 8,667,726 B1
(45) Date of Patent: Mar. 11, 2014

(54) HANDGUARD FOR TOY REPLICA FIREARM

(76) Inventor: Michael Huff, Tracy, CA (US)

( * ) Notice: Subject to any disclaimer, the term of this patent is extended or adjusted under 35 U.S.C. 154(b) by 149 days.

(21) Appl. No.: 13/525,589

(22) Filed: Jun. 18, 2012

(51) Int. Cl.
*F41C 23/00* (2006.01)

(52) U.S. Cl.
USPC ..... 42/71.01

(58) Field of Classification Search
USPC ..... 42/71.01
See application file for complete search history.

(56) References Cited

U.S. PATENT DOCUMENTS

| | | | | |
|---|---|---|---|---|
| 1,743,472 | A * | 1/1930 | Meyer | 89/138 |
| 2,628,536 | A * | 2/1953 | Schaich | 89/159 |
| 3,075,314 | A * | 1/1963 | Bakker | 42/71.01 |
| 4,536,982 | A * | 8/1985 | Bredbury et al. | 42/71.01 |
| 4,663,875 | A | 5/1987 | Tatro | |
| 4,856,218 | A * | 8/1989 | Reynolds, Jr. | 42/146 |
| 5,103,714 | A * | 4/1992 | LaFrance | 89/129.01 |
| 5,235,771 | A * | 8/1993 | Sokol et al. | 42/105 |
| 5,826,363 | A | 10/1998 | Olson | |
| 6,609,321 | B2 | 8/2003 | Faifer | |
| 6,792,711 | B2 * | 9/2004 | Battaglia | 42/114 |
| 6,945,154 | B1 | 9/2005 | Luth | |
| 8,316,574 | B1 * | 11/2012 | Swan | 42/146 |
| 8,336,243 | B2 * | 12/2012 | Langevin et al. | 42/71.01 |
| 8,393,107 | B2 * | 3/2013 | Brown | 42/105 |
| 8,561,335 | B2 * | 10/2013 | Brown | 42/71.01 |
| 8,561,517 | B2 * | 10/2013 | Brown | 89/1.4 |
| 8,578,642 | B2 * | 11/2013 | Troy et al. | 42/71.01 |
| 2008/0190002 | A1 | 8/2008 | Hines | |

OTHER PUBLICATIONS

"Airsoft" 12 pages downloaded from Wikipedia the Free Encyclopedia on Jun. 14, 2012.

AR15.Com—Home of the Black Rifle—Archive Server (in color). 14 pages dated Dec. 3, 2004 at 5:01:11 pm.

AR15.Com—Home of the Black Rifle—Archive Server (in black and white). 14 pages dated Dec. 3, 2004 at 5:01:11 pm.

"Handguard" 2 pages downloaded from Wikipedia the Free Encyclopedia on Jun. 14, 2012.

AirsoftStation.com "Thompson M1A1 Electric Full Metal Airsoft Rifle by Cybergun." 5 pages. Downloaded Jun. 14, 2012.

"Thompson submachine gun" 18 pages downloaded from Wikipedia the Free Encyclopedia on Jun. 14, 2012.

* cited by examiner

*Primary Examiner* — Michael David
(74) *Attorney, Agent, or Firm* — Silicon Edge Law Group LLP; Arthur J. Behiel

(57) ABSTRACT

A handguard encompasses the barrel of a replica firearm and supports one or more accessory rails. The handguard and the barrel have respective axes, which are offset from one another. The offset provides a pleasing aesthetic and a lower profile to accommodate sights without unduly obscuring the view of the shooter.

9 Claims, 2 Drawing Sheets

HANDGUARD FOR TOY REPLICA FIREARM

BACKGROUND

Many modern firearms include or accommodate standardized mounting platforms to receive a wide range of firearm accessories, such as scopes, sights, flashlights, sling mounts, and hand grips. Picatinny rails and Weaver rails, collectively referred to as "tactical rails," are common examples.

In a sport commonly referred to as Airsoft, participants engage in mock battles using replica firearms (Airsoft guns) that closely emulate real firearms but launch relatively harmless polymer spheres. Owners of replica firearms enjoy accessorizing their equipment, which has spawned a considerable market for many of the same types of accessories available for real firearms. Not surprisingly, replica accessories often follow the same standards as their real counterparts, both for a look of realism and for the benefits of standardization.

Many replica firearms, particularly those that emulate older weapons, do not support or include tactical rails. Owners of such replicas therefore have limited accessory options. There is therefore a demand for methods and devices for adapting standard tactical rails to replica firearms.

BRIEF DESCRIPTION OF THE FIGURES

The present invention is illustrated by way of example, and not by way of limitation, in the figures of the accompanying drawings and in which like reference numerals refer to similar elements.

DETAILED DESCRIPTION

Figure 1:
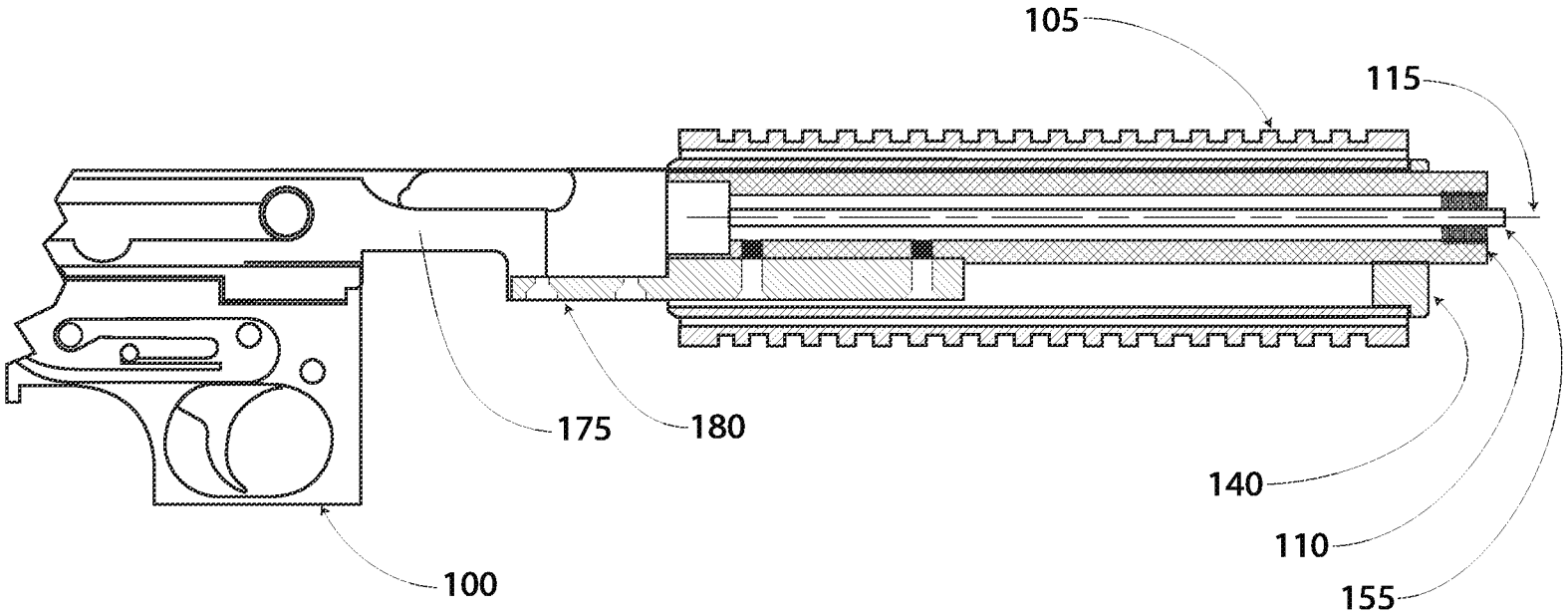
FIG. 1 is a side view capturing a portion of a conventional toy replica firearm 100 with a handguard 105 in accordance with one embodiment.
Figure 2:
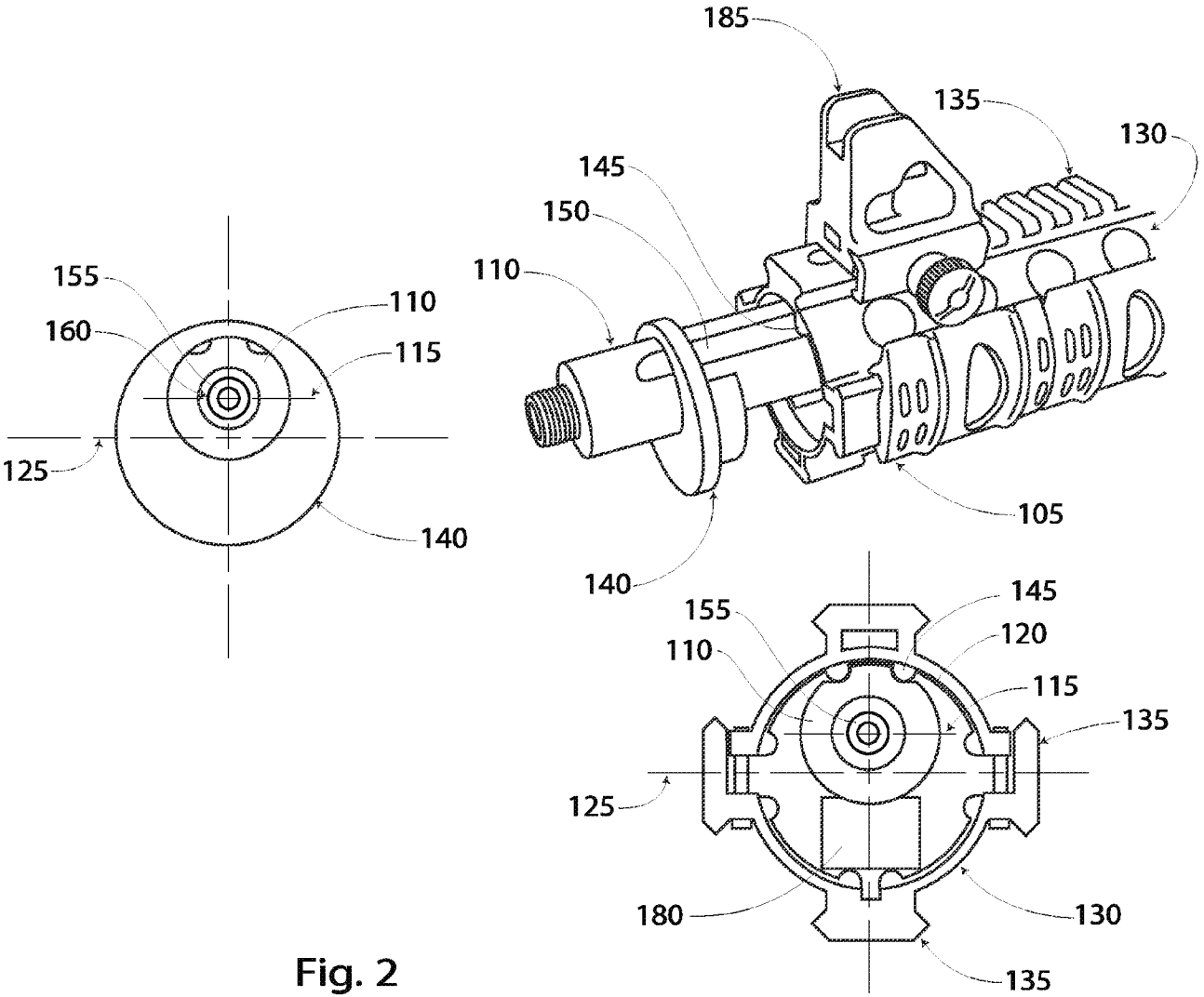
FIG. 2 includes views of handguard 105 and related components in accordance with the embodiment of FIG. 1.

FIG. 1 depicts part of a conventional toy replica firearm 100, which includes a handguard 105 to encompass a barrel 110, the barrel defining a barrel axis 115. As shown in FIG. 2, the handguard 105 includes a cylindrical inner surface 120 to receive the barrel 110, the cylindrical inner surface defining a handguard axis 125 normal to the page. The handguard 105 additionally includes an outer surface 130 supporting a number of accessory rails 135, and a bracket 140 to admit the barrel 110 and hold the barrel axis 115 parallel to and offset from the handguard axis 125.

In the embodiment of FIG. 2, the inner surface 120 of the handguard includes a pair of linear protuberances 145 that run parallel to the handguard axis 125, the linear protuberances to mate with corresponding grooves 150 in the barrel 110. In this example, barrel 110 is an outer barrel that encompasses and protects a cylindrical inner barrel 155 of an inner-barrel outside radius 160. The offset between axes 115 and 125 is greater than the inner-barrel outside radius.

Bracket 140 is connected to the handguard 105 and/or the barrel 110 to maintain the relative positions of those two parts. In some embodiments the bracket 140 maintains contact between the barrel 110 and the inner surface 120 of the handguard 105, which may advantageously provide a more solid feel to the user of the replica firearm 100. The replica firearm 100 includes a receiver 175 and a brace 180 to connect the barrel 110 to the receiver 175.

The accessory rails 135 can be e.g. Picatinny or Weaver rails, and facilitate the attachment of many accessories to the replica firearm 100. In the example of FIG. 2, a front sight 185 is shown mounted to accessory rail 135. The offset between axes 115 and 125 lowers the handguard 105 relative to the receiver 175, and thus provides a pleasing aesthetic and a lower profile to accommodate sights without unduly obscuring the view of the shooter.

While the present invention has been described in connection with specific embodiments, variations of these embodiments will be obvious to those of ordinary skill in the art. For example, the approaches described above can be for different types of firearms. Therefore, the spirit and scope of the appended claims should not be limited to the foregoing description. Only those claims specifically reciting "means for" or "step for" should be construed in the manner required under the sixth paragraph of 35 U.S.C. §112.

What is claimed is:

1. A handguard configured to encompass a barrel of a toy replica firearm, the barrel defining a barrel axis, the handguard comprising:

a cylindrical inner surface to receive the barrel of the toy replica firearm, the cylindrical inner surface defining a handguard axis;

an outer surface supporting an accessory rail; and a bracket to admit the barrel and hold the barrel axis parallel to and offset from the handguard axis;

wherein the barrel is an outer replica barrel configured to encompass a cylindrical inner barrel of an outside radius, and wherein the offset is greater than the outside radius.

2. The handguard of claim 1, wherein the inner surface includes a linear protuberance parallel to the handguard axis, the linear protuberance to mate with a corresponding groove in the barrel.

3. The handguard of claim 1, wherein the bracket maintains contact between the barrel and the inner surface.

4. The handguard of claim 1, wherein the replica firearm includes a receiver, the handguard further comprising a brace to connect to the receiver.

5. The handguard of claim 1, wherein the accessory rail is at least one of a Picatinny rail or a Weaver rail.

6. A toy replica firearm comprising:

a cylindrical inner barrel, of an outside radius, defining a barrel axis;

an outer replica barrel configured to encompass at least a portion of the inner barrel; and a handguard having a cylindrical inner surface surrounding at least a portion of the outer replica barrel, the cylindrical inner surface defining a handguard axis, an outer surface supporting an accessory rail, and a bracket securing the barrel axis parallel to and offset from the handguard axis, wherein the offset is greater than the outside radius of the inner barrel.

7. The firearm of claim 6, wherein the toy replica firearm is an Airsoft gun.

8. The firearm of claim 6, further comprising an accessory mounted to the accessory rail.

9. The firearm of claim 8, wherein the accessory is a sight.

* * * * *